US009328572B2

(12) United States Patent
Hughes

(10) Patent No.: US 9,328,572 B2
(45) Date of Patent: May 3, 2016

(54) GUIDE FUNNEL

(71) Applicant: Vetco Gray, Inc., Houston, TX (US)

(72) Inventor: Andrew David Hughes, Glasglow (GB)

(73) Assignee: Vetco Gray, Inc., Houston, TX (US)

( * ) Notice: Subject to any disclaimer, the term of this patent is extended or adjusted under 35 U.S.C. 154(b) by 355 days.

(21) Appl. No.: 13/627,299

(22) Filed: Sep. 26, 2012

(65) Prior Publication Data

US 2013/0075104 A1 Mar. 28, 2013

(30) Foreign Application Priority Data

Sep. 26, 2011 (EP) ..... 11182756

(51) Int. Cl.

| | |
|---|---|
| ***E21B 19/24*** | (2006.01) |
| ***E21B 17/07*** | (2006.01) |
| ***E21B 43/013*** | (2006.01) |
| ***E21B 41/00*** | (2006.01) |

(52) U.S. Cl.

CPC ..... *E21B 19/24* (2013.01); *E21B 17/07* (2013.01); *E21B 41/0014* (2013.01); *E21B 43/013* (2013.01)

(58) Field of Classification Search

None

See application file for complete search history.

(56) References Cited

U.S. PATENT DOCUMENTS

| | | | | |
|---|---|---|---|---|
| 3,688,840 | A * | 9/1972 | Curington | E21B 33/038 166/341 |
| 4,062,402 | A * | 12/1977 | Soulie | E21B 33/038 166/344 |
| 4,472,080 | A * | 9/1984 | Lawson | 405/169 |
| 4,832,878 | A * | 5/1989 | Scaccia | B01J 3/042 570/150 |
| 5,284,213 | A * | 2/1994 | Nobileau | E21B 7/12 175/161 |
| 5,868,203 | A | 2/1999 | Cunningham | |
| 6,336,508 | B1 * | 1/2002 | Guinn | E21B 33/038 166/339 |
| 6,766,861 | B2 * | 7/2004 | Koen | E21B 33/035 166/345 |
| 2003/0051877 | A1 | 3/2003 | Koen et al. | |
| 2010/0200241 | A1 * | 8/2010 | Ward | E21B 41/0014 166/341 |

FOREIGN PATENT DOCUMENTS

| | | | |
|---|---|---|---|
| CN | 201041013 | Y | 3/2008 |
| FR | 2936779 | A1 | 4/2010 |
| WO | 2009/014794 | A2 | 1/2009 |

OTHER PUBLICATIONS

EP Search Report from corresponding EP Patent Application 11182756.4 Date as Mar. 19, 2012.

EP Search Report and Written Opinion dated Feb. 4, 2014 from corresponding Application No. 11182756.4.

Unofficial English translation of Office Action issued in connection with related CN Application No. 201210362869.1 on Dec. 1, 2015.

* cited by examiner

*Primary Examiner* — Matthew R Buck
*Assistant Examiner* — Douglas S Wood
(74) *Attorney, Agent, or Firm* — GE Global Patent Operation

(57) ABSTRACT

A guide funnel for guiding a subsea infrastructure for connection with a subsea wellhead or mandrel profile is provided. The guide funnel comprises a plurality of sections, wherein the sections are collapsible such that the guide funnel can be in an extended state or a collapsed state.

16 Claims, 4 Drawing Sheets

GUIDE FUNNEL

BACKGROUND OF THE INVENTION

Embodiments of the subject matter disclosed herein generally relate to a guide funnel for guiding a subsea infrastructure, for example, a Christmas tree, a lower riser package (LRP) or a blow-out preventer (BOP), for the purpose of connection with a subsea wellhead or mandrel profile, and to a method of connecting a subsea infrastructure to a subsea wellhead or mandrel profile.

Guide funnels are well-known for guiding a subsea infrastructure, such as a Christmas free, for the purpose of connecting with a subsea wellhead. Such guide funnels may comprise an upwardly facing funnel on the wellhead to guide and receive the lower end portion of the tree as the tree is lowered into a vertically aligned position with the subsea wellhead. Such upwardly facing guidance funnels are suitable for use with conventional vertical trees, as these tend to have robust connectors at the bottom end for connection to the wellhead, which can easily withstand vertical impacts associated with the installation of the tree on the wellhead.

However, horizontal trees often contain more fragile connectors at the bottom end which must be aligned with the wellhead and which can be easily damaged if not properly aligned. In order to avoid damage to the tree connectors it is common to provide a downwardly facing funnel on the tree body around the connector for guiding the tree into correct alignment with the wellhead.

Industry standard ISO 13628-4:2010 specifies a minimum acceptable vertical alignment of 3 in guidance funnels for subsea wellhead and tree equipment. In accordance with the guidelines the height of the guidance funnel may be a significant proportion of the overall assembly height. Such large funnels have been found to impact on the transportation and deployability of trees, or other such equipment.

It is the object of the embodiments of the present invention to overcome some of the problems of the prior art, or at least to offer an alternative to currently available guidance funnels.

BRIEF DESCRIPTION OF THE INVENTION

According to an embodiment of the present invention, a guide funnel for guiding a subsea infrastructure for connection with a subsea wellhead or mandrel profile is provided. The guide funnel comprises a plurality of sections, wherein the sections are collapsible such that the guide funnel can be in an extended state or a collapsed state.

According to another embodiment of the present invention, a method of connecting a subsea infrastructure to a subsea wellhead or mandrel profile using a guide funnel for guiding the subsea infrastructure downwardly into an aligned position with the subsea wellhead or mandrel profile is provided. The guide funnel comprises a plurality of sections which are collapsible such that the guide funnel can be in an extended state or a collapsed state. The method comprises mounting the guide funnel to the subsea infrastructure so that it extends downwardly from a lower portion of the subsea infrastructure, actuating a retainer to deploy the guide funnel into the extended state; and lowering the subsea infrastructure and guide funnel downwardly onto the wellhead or mandrel profile such that the guide funnel meets an upper end of the wellhead or mandrel profile to guide the subsea infrastructure into position for connection to the wellhead or mandrel profile.

According to another embodiment of the present invention, a method of disconnecting a subsea infrastructure from a subsea wellhead or mandrel profile is provided. The subsea infrastructure includes a guide funnel for guiding the subsea infrastructure into an aligned position with the subsea wellhead or mandrel profile, the guide funnel comprising a plurality of sections which are collapsible such that the guide funnel can be in an extended state or a collapsed state, and a plurality of biased locking mechanisms configured to lock the plurality of sections into the extended state until a minimum load is applied. The method comprises raising the subsea infrastructure and guide funnel upwardly to disconnect it from the wellhead or mandrel profile, the guide funnel being in the extended state; and landing the subsea infrastructure and guide funnel out of water, such that the weight of the subsea infrastructure acts on the guide funnel and overcomes a minimum load of the biased locking mechanisms to force the guide funnel into the collapsed state.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION OF EXEMPLARY EMBODIMENTS OF THE INVENTION

Figure 1:
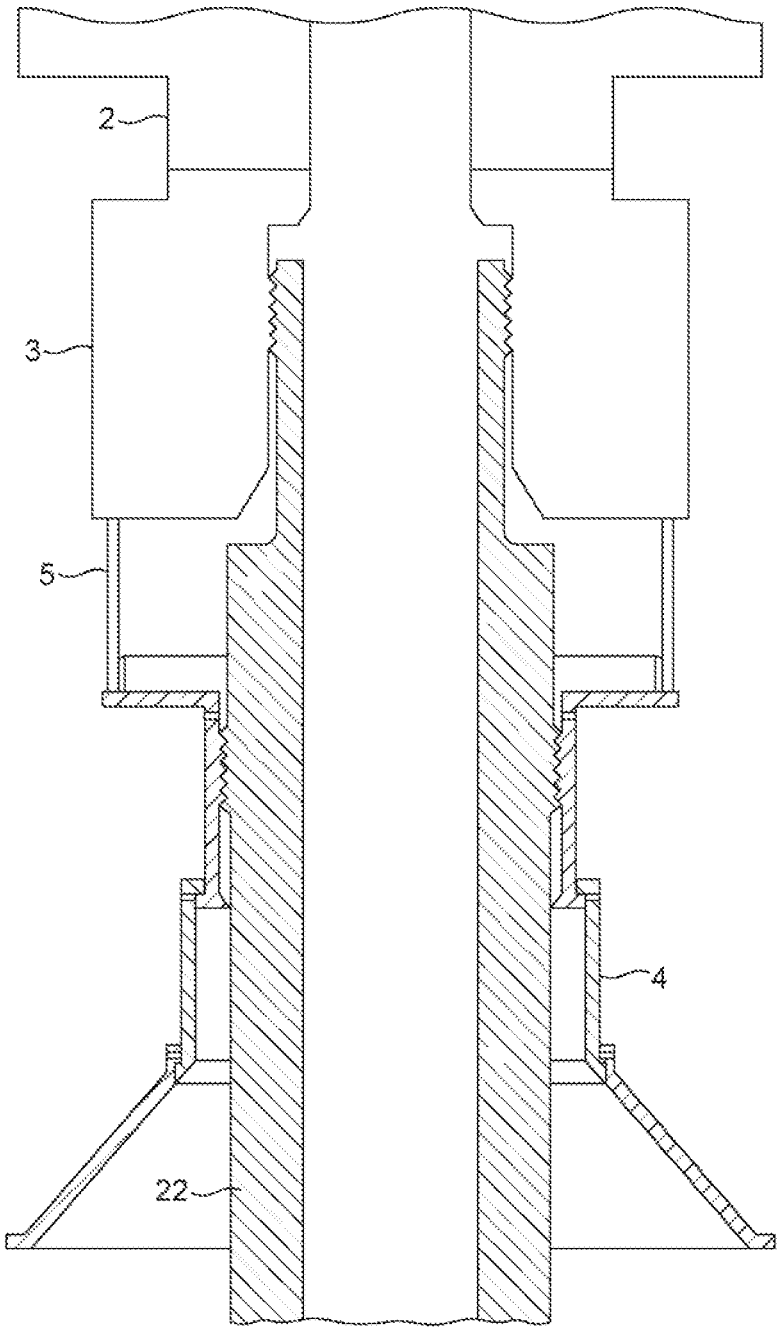
FIG. 1 shows a schematic cross-sectional view of a Christmas tree, with a guide funnel according to an embodiments of the present invention, mounted on a wellhead.

FIG. 1 shows a schematic cross sectional view of a Christmas tree 2 landed on a wellhead 22 on the sea bed. A connector 3 connects the tree 2 to a tree frame 5. Although the drawings and accompanying description refer to a tree 2, it will be appreciated a guide funnel according to embodiments of the present invention can be used to land any subsea infrastructure, such as a Christmas tree, BOP or LRP. A downwardly orientated guide funnel 4, which is described in more detail with reference to FIGS. 2-5, is attached to the tree frame 5. The guide funnel 4 is fabricated from steel or composite and is affixed to the tree frame 5, or alternatively to the tree body, or to the connector, by means of bolts, or any other suitable means. The guide funnel 4 is constructed from three linked sections 4*a*, 4*b*, 4*c*, although larger guide funnels are also envisaged. The operation of engaging the tree 2 with the wellhead 22 will also be described below, and will refer back to FIG. 1.

Figure 2:
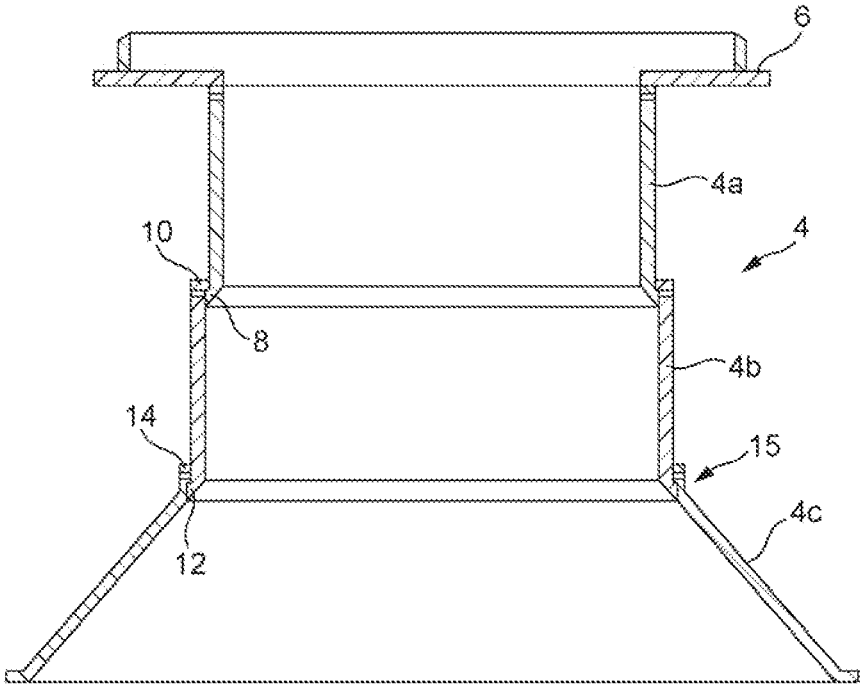
FIG. 2 shows a schematic representation of a first guide funnel according to an embodiment of the present invention in a collapsed state.
Figure 3:
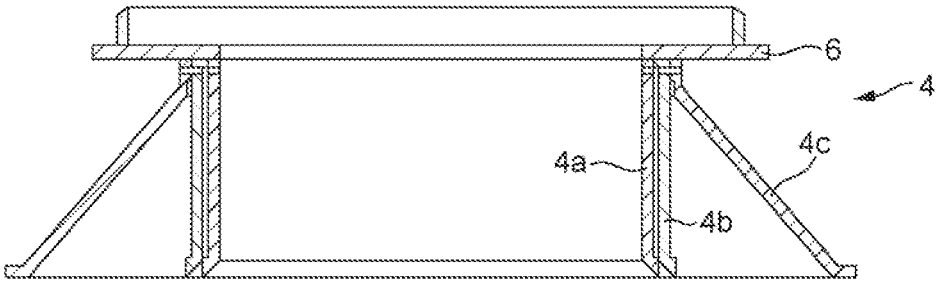
FIG. 3 shows a schematic representation of the guide funnel of FIG. 2 in an extended state.

Turning now to FIGS. 2 and 3, these show cross sections views of the guide funnel 4 in its extended state (FIG. 2) and in its collapsed state (FIG. 3). As can best be seen in FIG. 2, the guide funnel 4 comprises three sections 4*a*, 4*b*, 4*c*. In the extended state the three sections 4*a*, 4*b*, 4*c* form a guide funnel 4 which functions much like a conventional guide funnel.

A first, generally cylindrical, section 4*a* has the smallest diameter of the three sections. The first section 4*a* has an outwardly projecting flange 6 around the top of its cylindrical wall, and an outwardly projecting rim 8 around the bottom of the cylindrical wall. In use the first section 4*a* will be welded to a tree 2, as shown in FIG. 1, or it will be affixed to the tree 2 by other suitable means.

A second, generally cylindrical, section 4*b* has an inner diameter which is slightly larger than the outer diameter of the first cylindrical section 4*a*, such that the inner surface of the second section 4*b* may slide over the outer surface of the first section 4*a* (as will be described with reference to FIG. 3). The second section 4*b* has an inwardly projecting rim 10 around the top of its cylindrical wall. When the guide funnel 4 is in its extended state the inwardly projecting rim 10 abuts the outwardly projecting rim 8 around the bottom of the cylindrical wall of the first section 4*a*. This limits the downward vertical movement of the second section 4*b*. The second section 4*b* also has an outwardly projecting rim 12 around the bottom of its cylindrical wall.

A third, generally conical, section 4*c* has a minimum inner diameter which is slightly larger than the outer diameter of the second cylindrical section 4*b*, such that a portion of the inner surface of the third section 4*c* may slide over the outer surface of the second section 4*b* (as will be described with reference to FIG. 3). The third section 4*c* has a cylindrical section 15 defining its minimum inner diameter and an inwardly projecting rim 14 running around the cylindrical section 15. When the guide funnel 4 is in its extended state the inwardly projecting rim 14 abuts the outwardly projecting rim 12 around the bottom of the cylindrical wall of the second section 4*b*. This limits the downward vertical movement of the third section 4*c*.

Referring now specifically to FIG. 3, the guide tunnel 4 of FIG. 2 is shown in its collapsed state. The sections 4*a*, 4*b*, 4*c* are concentric when in the collapsed state. This is the state in which the funnel 4 will be stored for transportation. As can clearly be seen, the vertical dimension of the funnel 4 in its collapsed state is approximately one third of the extended funnel. This represents a significant reduction and greatly improves the transportation and deployability of the funnel 4.

In the collapsed state the third section 4*c* is slid upwards such that it overlaps the second section 4*b*. Similarly, the second section 4*b* is slid upwards such that it (and the third section 4*c*) overlaps the first section 4*a*. The outwardly projecting flange 6 of the first section 4*a* prevents the second 4*b* and third sections 4*c* from disengaging from the first section 4*a*. In the construction of the guide funnel 4 the sections 4*a*, 4*b*, 4*c* are typically assembled together and then the outwardly projecting flange 6 is welded to the first section 4*a* to secure the three sections 4*a*, 4*b*, 4*c* together. As will be described in more detail with reference to FIG. 4, the funnel 4 is generally provided with a retainer for securing the sections 4*a*, 4*b*, 4*c* in the collapsed state. Once the retainer is removed the weight of the funnel 4 is generally sufficient such that the sections 4*a*, 4*b*, 4*c* are deployed into their extended state under the influence of gravity.

Figure 4:
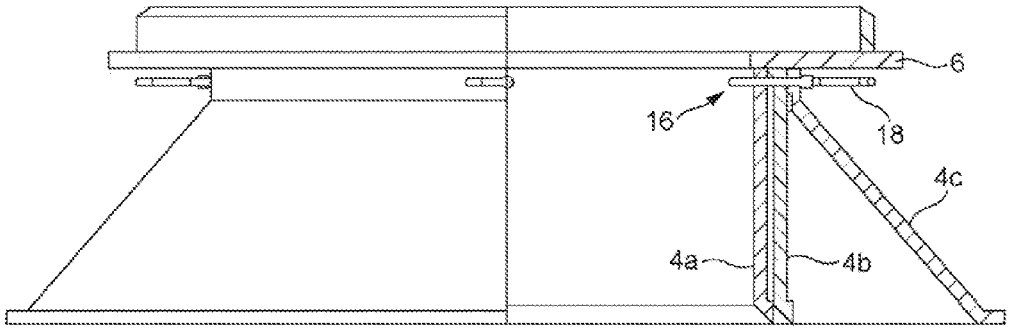
FIG. 4 shows a schematic representation of a second guide funnel according to an embodiment of the present invention in a collapsed state.

FIG. 4 shows a schematic representation (in partial cross section) of a guide funnel 4 according to an embodiment of the present invention, with means for retaining the funnel sections in the collapsed state. The remaining sections of the funnel 4 are the same as those described in FIGS. 2 and 3, and like parts will be numbered accordingly. Each section 4*a*, 4*b*, 4*c* of the guide funnel 4 comprises four apertures 16, evenly spaced around the circumference, which align with corresponding apertures 16 in the other sections 4*a*, 4*b*, 4*c* when the funnel 4 is in its collapsed state. The means for retaining the sections 4*a*, 4*b*, 4*c* in the collapsed state comprises retaining pins 18 which pass through the apertures 16 when they are aligned and hold the sections 4*a*, 4*b*. 4*c* together. The pins 18 are locked using hitched pins interfacing with nuts bolted to the outside diameter of the tunnel 4. Alternative methods for retaining the sections 4*a*, 4*b*, 4*c* in the collapsed state, such as screws, are also envisaged.

The retaining pins 18 of FIG. 4 must be manually removed prior to deployment of the tree 2. This is generally performed by an operator located on the surface. In alternative embodiments the retaining means may be remotely actuated, for example, by a remote operated vehicle (ROV), a remotely actuable switch which may be acuated by an operator on the surface, or by a proximity switch which is actuated when the funnel is in proximity to a sensor located on the wellhead 22.

Figure 5:
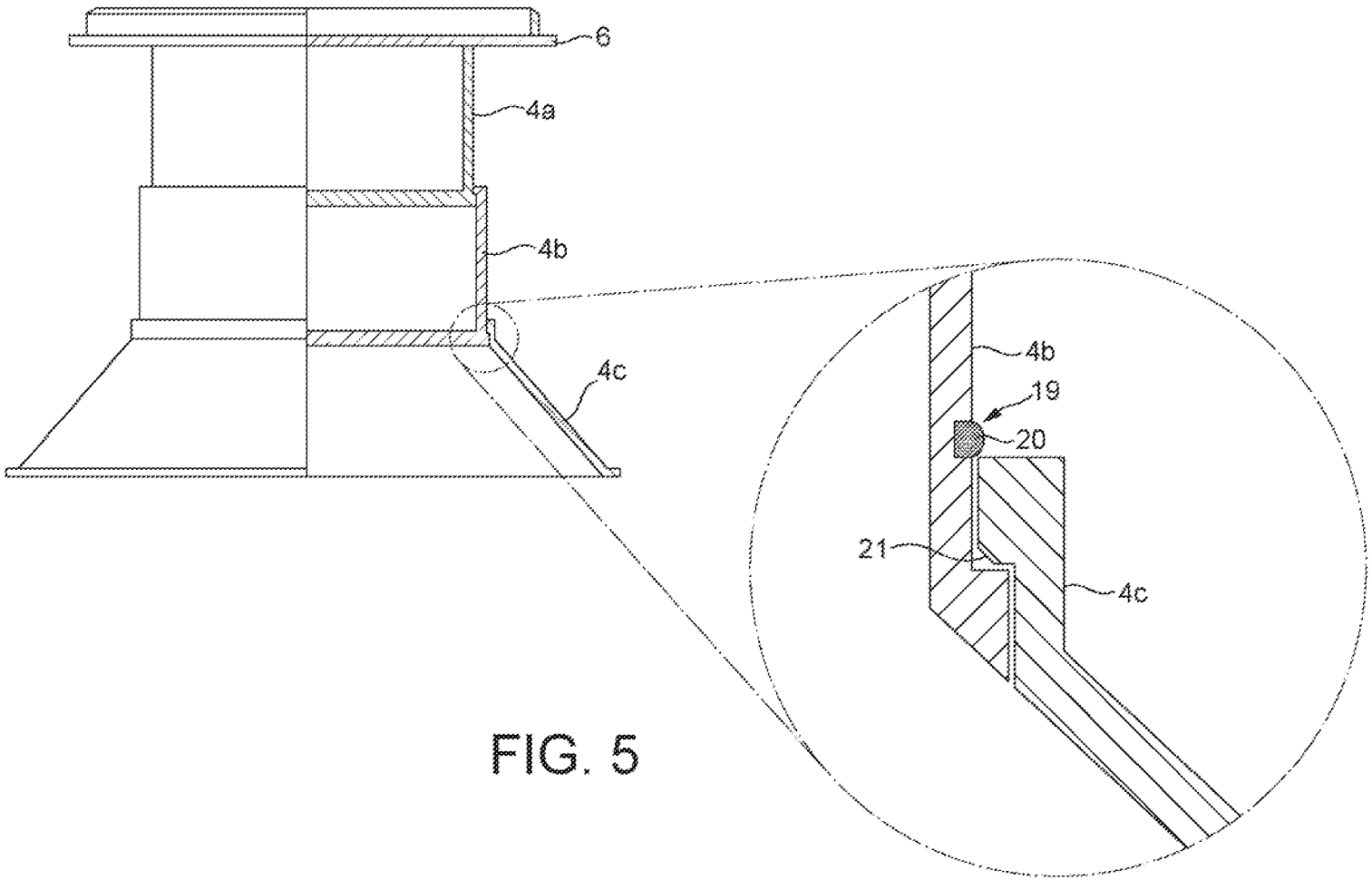
FIG. 5 shows a schematic representation of a third guide funnel according to an embodiment of the present invention in an extended state.

FIG. 5 shows a schematic representation (in partial cross section) of a further guide funnel 4 according to an embodiment of the present invention, with a locking mechanism for locking the funnel 4 in its extended state. As with the guide funnel 4 of FIG. 4, the remaining sections of the funnel 4 are the same as those described in FIGS. 2 and 3, and like parts will be numbered accordingly. As can best be seen in the detail section of FIG. 5, the locking mechanism comprises an outwardly biased split ring member 19 which extends around the circumference of the second section 4*b* for biasing the third section 4*c* into the extended state. A similar outwardly biased split ring member 19 is provided around the circumference of the first section 4*a* for biasing the second section 4*b* into the extended state.

The outwardly biased member 19 has a downwardly sloping surface 20. A corresponding downwardly sloping surface 21 is provided on an inner edge of the inwardly projecting rim 14 of the third section 4*c*. When moving from the collapsed state to the extended state the downwardly sloping surface 21 on the inner edge of the inwardly projecting rim 14 contacts the downwardly sloping surface 20 on the outwardly biased member 19. The weight of the third section 4*c* is generally sufficient to overcome the biasing force of the outwardly biased member 19, pushing the member 19 inwards and permitting the third section 4*c* to slide into the extended state. Once in the extended state, the bottom surface of the outwardly biased member 19 abuts atop surface of the third section 4*c* and prevents the third section 4*c* from collapsing under the loads normally experienced during use of the guide funnel 4. Typically any loads experienced during use of the funnel 4 will be as a result of impact on tire wellhead 22 or other subsea structure during installation. These impacts will tend to impart an uneven load to the funnel 4, and in turn the outwardly biased member 19, which will not be sufficient to overcome the biasing force. This is because tire biasing member 19 extends around the circumference of the first 4*a* and second 4*b* sections respectfully, and it requires an even compressive force to overcome the biasing force. Such an even force is generally experienced when the tree 2 is landed on the surface. Since the funnel 4 is located at the lowest extremity of the tree 2 it makes first contact when the tree 2 is landed on a solid surface. Thus, an even compressive loading is imparted to the funnel 4, and in turn the outwardly biased member 19, which overcomes the biasing force and permits the funnel 4 to collapse into its collapsed state.

Referring now to FIG. 1, the general method of connecting a tree 2, or other subsea infrastructure, to a wellhead 22 using the collapsible guide funnel 4 according to embodiments of the present invention will now be described. The first stage involves the mounting of the guide funnel 4 to the tree 2 so that it extends downwardly from a lower portion of the tree body in axial alignment with the tree bore. This will generally be done by a weld, as shown in FIG. 1, but the funnel 4 can also be screwed to the tree body. For storage and transportation the guide funnel 4 will generally be stored in its collapsed state, as shown in FIG. 3, and retaining means, such as the retaining pins 18 shown in FIG. 4 will be used to retain the funnel 4 in its collapsed state. Next, the retaining pins 18 are removed to deploy the guide funnel 4 into its extended state. This is generally performed manually be an operator located on the surface, but other means, such as remote actuation are also envisaged. Once the pins 18 are removed the force of gravity acting on the sections 4*a*, 4*b*, 4*c* is generally sufficient to cause the funnel 4 to be deployed to its extended state. Once the funnel 4 is deployed into its extended state, a locking mechanism, such as the one illustrated in FIG. 5, locks the sections 4*a*, 4*b*, 4*c* of the funnel 4 into the extended state. In the embodiments illustrated in FIGS. 1-5 the funnel 4 comprises three sections 4*a*, 4*b*, 4*c*. However, larger funnels having more sections are also envisaged. Once the funnel 4 is locked into its extended state it functions in the same manner as a conventional guide funnel. The tree 2 and guide funnel 4 are lowered downwardly onto the wellhead 22 such that the guide funnel 4 meets an upper end of the wellhead 22 to guide the tree 2 into position for connection to the wellhead 22.

According to an embodiment of the present invention a guide funnel for guiding a subsea infrastructure, such as a Christmas tree, LRP or BOP, for the purpose of connection with a subsea wellhead or mandrel profile is provided, wherein the guide funnel comprises a plurality of sections, and wherein the sections are collapsible such that the guide funnel can exist in an extended or collapsed state. A guide funnel according to embodiments of the present invention is capable of meeting the standards required by ISO 13628-4: 2010, but is also capable of existing in a collapsed state for improved transportation and deployability.

According to an embodiment of the present invention the plurality of sections are concentric in their collapsed state. The guide funnel will typically be constructed from a plurality of linked cylindrical sections aid at least one cone section. When the guide funnel is in its extended state the, or each, cone section will be at the end remote from the tree. Beginning with the first cylindrical section, which is typically attached to the tree, the diameter of each subsequent section is larger than that of the previous section. When in the collapsed state the guide funnel sections sit inside one another, with the larger diameter section being on the outside.

According to an embodiment of the present invention, the guide funnel comprises a retainer for retaining the sections in the collapsed state prior to use of the funnel.

According to an embodiment of the present invention, the retainer comprises at least one retaining pin, and the sections comprise apertures which align when the sections are in the collapsed state, such that the, or each, retaining pin can pass through the apertures.

According to an embodiment of the present invention, the retainer is manually actuable. When the retainer is manually actuable it must be released prior to deployment of the tree. This will typically be done by an operator on the surface.

According to an embodiment of the present invention, the retainer is remotely actuable. When the retainer is remotely actuable it may be released either on the surface or at any point prior to engagement with the wellhead. Typically, the means for remote actuation will be provided on the surface. In an embodiment of the invention the means may comprise a proximity detector which releases the retainer when in proximity to a sensor on the wellhead. Alternatively, the retainer may be remotely actuated by a remotely operated vehicle (ROV).

According to an embodiment of the present invention, the guide funnel is arranged such that, in use, when the retainer is removed the sections extend into the extended state under the influence of gravity.

According to an embodiment of the present invention the guide funnel further comprises a locking mechanism for locking the sections in the extended state.

According to an embodiment of the present invention, a locking mechanism is provided between all adjacent sections.

According to an embodiment of the present invention, the locking mechanism comprises biased members. The locking mechanism may comprise spring biased members.

According to an embodiment of the present invention, tire biased members are configured to prevent collapse of the funnel until a minimum load is applied. The "minimum load" required to overcome the biased members and cause collapse of the funnel will typically be greater than the loads the funnel will be subjected to during engagement of the tree with the wellhead. Since it is located at a lower extremity of the tree the funnel will typically be the first contact point when the funnel is landed on the surface. The "minimum load" should be configured such that the weight of the tree acting on the funnel out of water is sufficient to cause the funnel to collapse.

According to an embodiment of the present invention, a method of connecting a subsea infrastructure to a subsea wellhead or mandrel profile using a guide funnel for guiding the subsea infrastructure downwardly into an aligned position with the subsea wellhead or mandrel profile is provided. The guide funnel comprises a plurality of sections which are collapsible such that the guide funnel can exist in an extended or collapsed state. The method comprises mounting the guide funnel to the subsea infrastructure so that it extends downwardly from a lower portion of the subsea infrastructure, actuating a retainer to deploy the guide funnel into its extended state; and lowering the subsea infrastructure and guide funnel downwardly onto said wellhead or mandrel profile such that the guide funnel meets an upper end of the wellhead or mandrel profile to guide the subsea infrastructure into position for connection to the wellhead or mandrel profile.

According to an embodiment of the present invention, the subsea infrastructure is a Christmas tree, the tree having a body and a bore extending through said body, wherein the method comprises the step of mounting the guide funnel in axial alignment with the tree bore.

The collapsible guide funnel may have any of the features of the guide funnel described above.

Thus, while there has been shown and described and pointed out fundamental novel features of the invention as applied to exemplary embodiments thereof it will be understood that various omissions and substitutions and charges in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A guide funnel for guiding a subsea infrastructure for connection with a subsea wellhead or mandrel profile, the guide funnel comprising:

a plurality of sections, wherein the sections are collapsible such that the guide funnel can be in an extended state or a collapsed state; and a locking mechanism for locking the plurality of sections in the extended state;

wherein the locking mechanism comprises:

a biased member, wherein the biased member is configured to prevent collapse of the guide funnel until an even compressive force is applied.

2. The guide funnel according to claim 1, wherein the subsea infrastructure is a Christmas tree, a lower riser package, or a blow-out preventer.

3. The guide funnel according to claim 1, wherein the plurality of sections are concentric in the collapsed state.

4. The guide funnel according to claim 1, further comprising a retainer configured to retain the plurality of sections in the collapsed state.

5. The guide funnel according to claim 4, wherein the retainer comprises at least one retaining pin, wherein the plurality of sections comprise apertures which align when the plurality of sections are in the collapsed state, and wherein the apertures are configured to receive the at least one retaining pin.

6. The guide funnel according to claim 4, wherein the retainer is manually actuable.

7. The guide funnel according to claim 4, wherein the retainer is remotely actuable.

8. The guide funnel according to claim 5, wherein the plurality of sections extend into the extended state under the influence of gravity when the apertures do not receive the at least one retaining pin.

9. The guide funnel according to claim 1, further comprising at least one locking mechanism arranged between all adjacent sections.

10. The guide funnel according to claim 1, wherein the even compressive force is applied to the guide funnel when the guide funnel meets an upper end of the wellhead or mandrel profile.

11. A method of connecting a subsea infrastructure to a subsea wellhead or mandrel profile using a guide funnel for guiding the subsea infrastructure downwardly into an aligned position with the subsea wellhead or mandrel profile, the guide funnel comprising a plurality of sections which are collapsible such that the guide funnel can be in an extended state or a collapsed state, the method comprising:

mounting the guide funnel to the subsea infrastructure so that the guide funnel extends downwardly from a lower portion of the subsea infrastructure;

actuating a retainer to deploy the guide funnel into the extended state; and lowering the subsea infrastructure and the guide funnel downwardly onto the wellhead or mandrel profile such that the guide funnel meets an upper end of the wellhead or mandrel profile to guide the subsea infrastructure into position for connection to the wellhead or mandrel profile, wherein the guide funnel further comprises a locking mechanism for locking the plurality of sections in the extended state, wherein the locking mechanism comprises a biased member, wherein the biased member is configured to prevent collapse of the guide funnel until an even compressive force is applied.

12. The method according to claim 11, wherein the subsea infrastructure is a Christmas tree, the tree having a body and a bore extending through the body, wherein the method further comprises mounting the guide funnel in axial alignment with the tree bore.

13. The method according to claim 11, wherein actuating the retainer comprises manually actuating the retainer.

14. The method according to claim 11, wherein actuating the retainer comprises remotely actuating the retainer.

15. A method of disconnecting a subsea infrastructure from a subsea wellhead or mandrel profile, the subsea infrastructure having a guide funnel for guiding the subsea infrastructure into an aligned position with the subsea wellhead or mandrel profile, the guide funnel comprising a plurality of sections which are collapsible such that the guide funnel can be in an extended state or a collapsed state, and a plurality of locking mechanisms configured to lock the plurality of sections into the extended state until an even compressive force is applied, the method comprising:

raising the subsea infrastructure and the guide funnel upwardly to disconnect the subsea infrastructure from the wellhead or mandrel profile, the guide funnel being in the extended state; and landing the subsea infrastructure and guide funnel out of water, such that the weight of the subsea infrastructure acts on the guide funnel and overcomes a minimum load of the biased locking mechanisms to force the guide funnel into the collapsed state, wherein the guide funnel further comprises the plurality of locking mechanisms for locking the plurality of sections in the extended state, wherein each locking mechanism comprises a biased member, wherein the biased member is configured to prevent collapse of the guide funnel until an even compressive force is applied.

16. The method according to claim 15, wherein the subsea infrastructure is a Christmas tree, the tree having a body and a bore extending through the body, wherein the method further comprises mounting the guide funnel in axial alignment with the tree bore.

* * * * *